US005161689A

United States Patent [19]

Balson

[11] Patent Number: 5,161,689

[45] Date of Patent: Nov. 10, 1992

[54] RIM SEAL FOR PAINT CAN LID

[76] Inventor: John E. Balson, 227 Lancaster Ave., Devon, Pa. 19333

[21] Appl. No.: 669,619

[22] Filed: Mar. 14, 1991

[51] Int. Cl.[5] ..... B65D 25/20

[52] U.S. Cl. ..... 206/509; 206/508; 220/698; 220/700

[58] Field of Search ..... 206/503, 508, 509; 220/90, 698, 699, 700

[56] References Cited

U.S. PATENT DOCUMENTS

| | | | |
|---|---|---|---|
| 2,591,482 | 4/1952 | Weltlich | 220/700 |
| 3,309,000 | 3/1967 | Haverstick | 220/698 X |
| 3,469,735 | 9/1969 | Burt | 220/90 |
| 3,480,177 | 11/1969 | Elliot | 206/509 |
| 3,693,829 | 9/1972 | Price | 220/698 |
| 3,913,785 | 10/1975 | Pattershall | 206/508 X |

*Primary Examiner*—Steven M. Pollard
*Attorney, Agent, or Firm*—Eugene E. Renz, Jr.

[57] ABSTRACT

A rim seal for use with containers for paint having an upstanding rim at one end and a groove located radially inwardly of the rim defined in part by an inner terminal edge. The rim seal includes an annular top section disposed generally transverely to the axis of a container and providing a planar support surface when assembled to a container. An inner wall section extends downwardly at an angle from the inner peripheral edge of the top section terminating in a radially inwardly directed rib adapted to overlie and seal with the edge of the container. Also, an angular outer section depending from the outer peripheral edge of the top section includes a radial section defining a ledge, and a lower terminal axially extending wall terminating and having an inwardly directed radial circumferentially extending rib. Application of an axial force on the top section produces outward flexing of the inner and outer sections whereby the rim seal can be applied to a container by automatic assembly means.

5 Claims, 5 Drawing Sheets

10
10
10
12
12
12
10
10
10
10L
50
52
Ss
54
54a
54b
56
58
58
53
60
62

FIG. 12
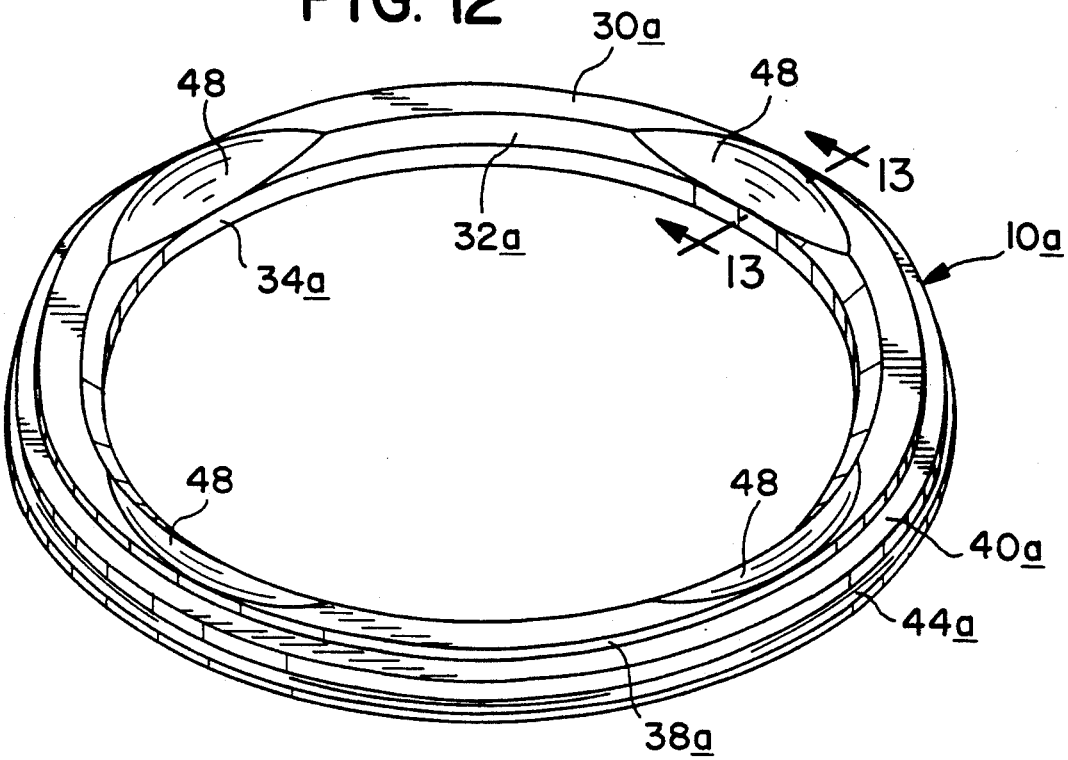
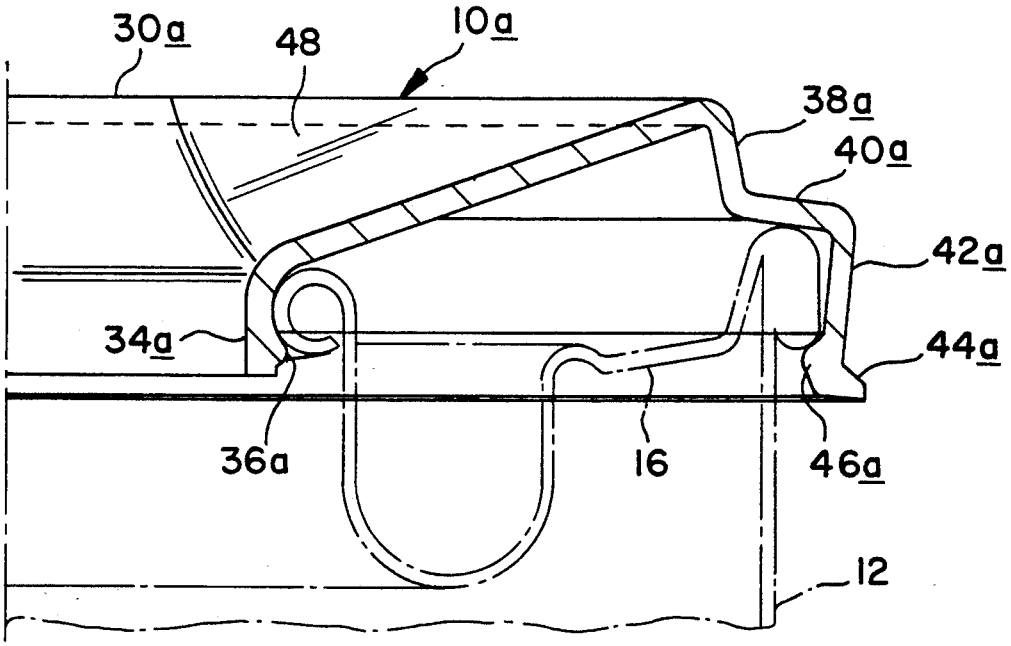
FIG. 13

RIM SEAL FOR PAINT CAN LID

FIELD OF THE INVENTION

The present invention relates to improvements in so called rim seals for paint cans and the like, which function to prevent accumulation of paint in an annular groove in the can within which the lid seats and locks.

BACKGROUND OF THE INVENTION

While paint and other similar materials have been improved by various new formulations over the many years and the paint has been available in cans, the paint can itself has not changed significantly. Paint cans have remained generally cylindrical containers having a top configuration defining a groove for the paint can lid.

There are some areas of packaging, displaying and use of paint cans which can be improved. For example, no matter how great the degree of care, both professional and nonprofessional painters have to deal with the problem of paint accumulating in the groove for the lid and paint running down the outside of the paint can. If the paint in the groove is not removed, it creates problems with application and removal of the lid.

When retail paint stores display paint in cans, such as by stacking two, three, four or more cans on top of each other, the inherent instability of the can as a stacking container becomes a detriment to effective promotion and display of the product. When paint is displayed on shelves and not in stacks, placement of the cans in, and removal of the cans out of the shelves sometimes causes damage to the lid and can junction.

Typically, paint cans are packaged in cardboard containers or the like for shipment from manufactures to distributors or retail outlets. While this type of packaging is generally satisfactory and effective to protect the product during shipment, it is rather expensive and requires a variety of package sizes for shipping different quantities. Furthermore, this type of packaging is rather expensive.

Rim seals for paint cans are not new per se. However, the present designs have disadvantages and drawbacks as discussed below.

For example, U.S. Pat. No. 2,630,241 discloses a drip tray for paint cans which functionally increases the area around the paint can because of the drip tray. This device is expensive, cumbersome, and cannot be used when the paint is poured from the can. This early 1950's patent describes a device which has been outmoded with the advent of painting with rollers or pads.

In a simpler design, U.S. Pat. No. 4,369,890 describes a paint collar which has various lips which engage the paint can rim. Among its limitations is the fact that the paint cannot be poured, and the device does not protect the groove from paint accumulation.

An alternative protective device for paint containers is shown in U.S. Pat. No. 3,693,829. This device is also totally unsuited for pouring, as the upwardly sloping terminal flange prevents pouring without creating an even greater waste of paint.

Finally U.S Pat. No. 3,469,735 describes a resealer device which keeps the groove at the top of a paint can clean by filling it with a solid plastic material which is generally sized to fit the can groove. The device functions primarily as a substitute lid with a hole in the center, and appears to require relatively precise dimensioning in order to function effectively. In addition, due to its design, this patent not only does not suggest that more than one paint can may be stacked on another, but in fact describes the device as one which would actually prevent the stacking of cans. Specifically, the anvil rib portion, or the raised cylindrical part which is used for resealing, prevents such stacking. More importantly, due to the bidirectional annular ribs, it is not possible to ship the device in the carton in which paint cans are normally shipped. Finally, it is also clear that the device cannot function as intended without the age old problem of paint run down the sides of the can.

SUMMARY OF THE INVENTION

With the foregoing in mind, it is the object of the present invention to provide an improved rim seal which is relatively easy to apply to the top of a paint can in sealing, overlying relationship to the annular groove, and which effectively prevents accumulation of paint in the groove during pouring of paint from the can, or when feathering a brush over the edge of a can as is customary during painting procedures. The rim seal is characterized by novel features of construction and arrangement facilitating automatic assembly of the rim seal to cans for stacking, packaging, shipping and display purposes. The design of the rim seal is such that it can be automatically applied to either end of the can and, when the cans are stacked, the rim seals function to stabilize the stack so that the stacked cans can be displayed without the danger of the cans tumbling and falling.

BRIEF DESCRIPTION OF THE DRAWINGS

These and other objects of the present invention and the various features and details of the operation and construction thereof are hereinafter more fully set forth with reference to the accompanying drawings, where:

FIG. 12 is a perspective view of a modified paint can rim seal in accordance with the present invention; and FIG. 13 is an enlarged fragmentary sectional view taken on lines 13—13 of FIG. 12.

DETAILED DESCRIPTION OF THE PREFERRED EMBODIMENT

Figure 1:
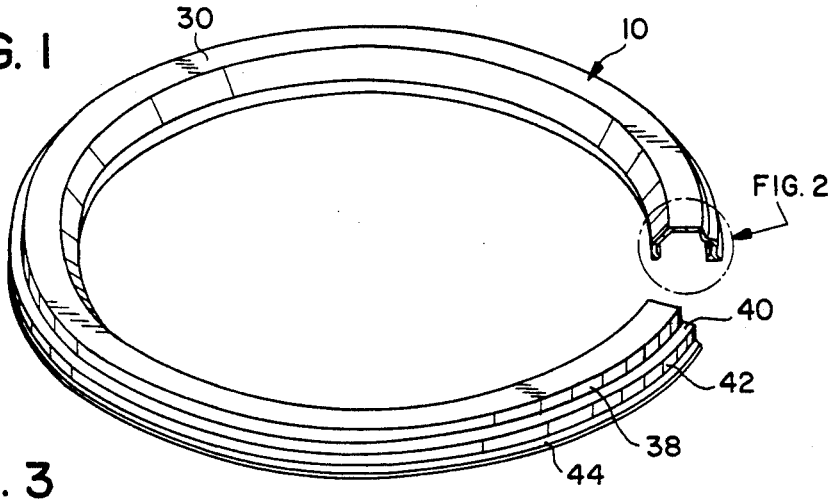
FIG. 1 is a perspective view of a paint can rim seal embodying the features of the present invention.
Figure 3:
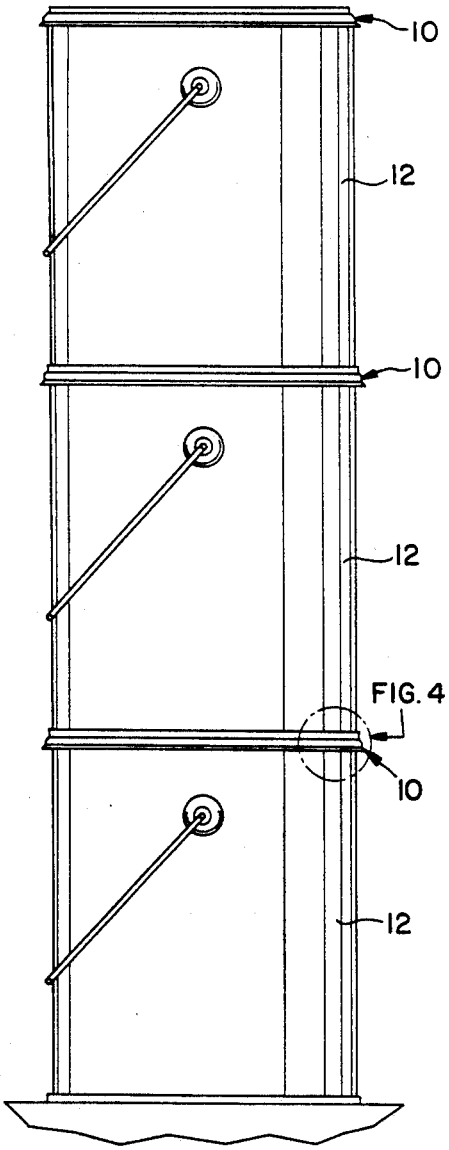
FIG. 3 shows a configuration of stacked paint cans supported in an up right column by the paint rim seal of the present invention.

Referring now to the drawings and particularly to FIG. 1 thereof, there is shown a paint rim seal constructed in accordance with the present invention generally designated by the numeral 10. The rim seal 10 is adapted for use on a conventional paint can which typically comprises a generally cylindrical body portion or side wall 12 having a disc like bottom wall 14 which is crimped or otherwise secured to the lower terminal edge of the cylindrical body 12. The bottom wall 23 typically has a flat planar or central section 25 and is offset and dished inwardly around its periphery adjacent the side wall 12. A lid retention flange 16 is secured by crimping to the upper end of the cylindrical body 12 to form a chime 17. The flange 16 also includes a circumferentially extending groove 18 within which the bead 20 of the lid 21 normally seats to seal the can. The inner end of groove 18 terminates in rolled lip 19.

The paint can rim seal 10 of the present invention is characterized by novel features of construction and arrangement facilitating easy and quick manual or automatic application to a paint can to provide several advantageous features. For example, the rim seal 10 seats over the flange 16 with the lid removed in such a manner as to prevent accumulation of paint in the groove 18 when pouring paint from the can, or during painting procedures by the normal wiping action of a paint filled brush on the rim seal. The rim seal is also capable of being applied to the lower end of the can for use as a support for the can when in use. The rim seal may be applied manually, or by automatic equipment, to filled cans for the stacking of cans on display counters, and for packaging and shipment in a manner described in more detail below.

Figure 2:
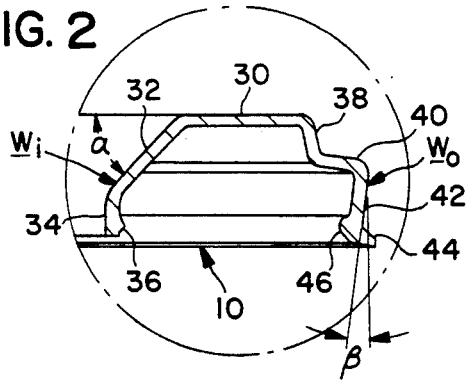
FIG. 2 is an enlarged sectional view of the rim seal of the circle portion of FIG. 1.
Figure 4:
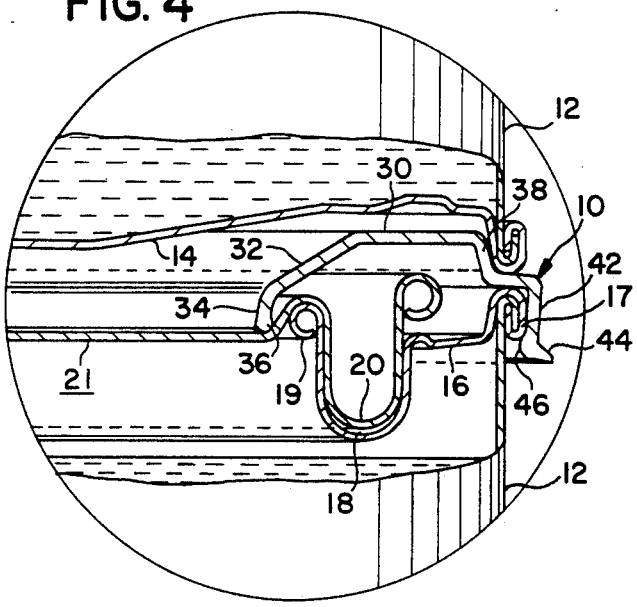
FIG. 4 is an enlarged fragmentary sectional elevational view of that portion of the stack cans shown in FIG. 3 by the dot and dash circle and designated FIG. 4.
Figure 5:
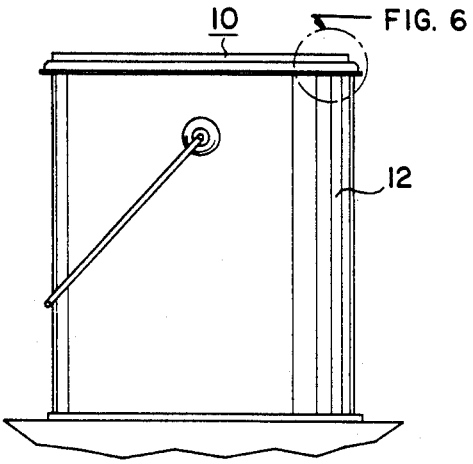
FIG. 5 is a side elevational view of a can with a rim seal in accordance with the present invention applied to the upper part of the can with the top removed.
Figure 8:
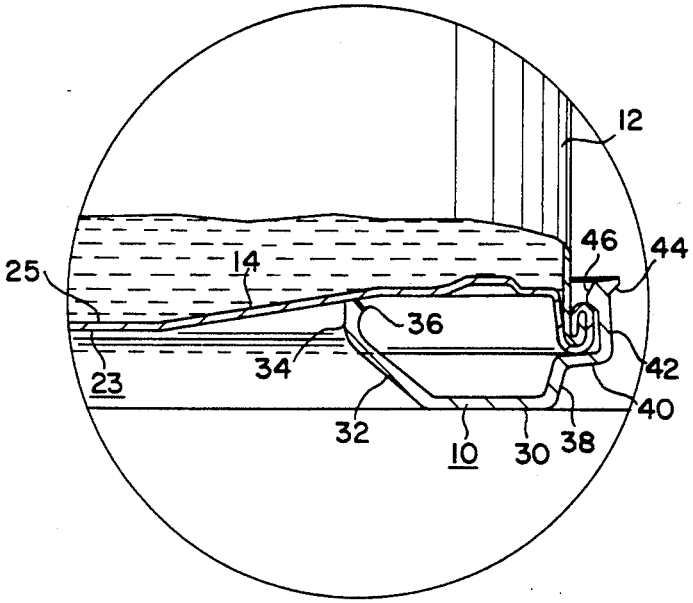
FIG. 8 is an enlarged fragmentary sectional elevational view of that portion of the can and rim seal enclosed by the dot and dash circle in FIG. 7 and designated FIG. 8.

To this end, the rim seal, as best illustrated in FIGS. 1 and 2, comprises an annular ring-like member having a planar top wall 30 disposed generally transversely to the axis A—A of a paint can when seated on the paint can in the manner shown in FIGS. 4 and 8. The rim seal has an inner wall section $W_i$ comprising a frusto conical inner wall 32 depending at a predetermined angle $\alpha$ of about 45° from the inner edge of the top wall 30, and having a generally axially directed lower terminal portion 34 with a circumferentially extending inwardly directed sealing bead 36. The rim seal 10 has an outer wall section $W_o$ including an upper axial side wall 38, a radially outwardly directed slightly downwardly depending slanted ledge 40, and a lower slightly inwardly inclined axial wall 42 having an outwardly directed beveled deflecting skirt 44 and a circumferentially extending radially inwardly directed locking bead 46. The wall 42 is preferably inclined inwardly at an angle $\beta$ of between 6° and 10°. The planar wall 30 is preferably disposed centrally of the inner and outer wall sections $W_i$ and $W_o$ whereby application of an evenly distributed vertical force F effects or causes generally equal displacement of the inner and the outer wall sections $W_i$ and $W_o$ to produce the desired tight seating and sealing without cocking of the paint rim seal during the assembly application. The planar wall 30 then may be described as a forced distribution bridging wall.

Figure 6:
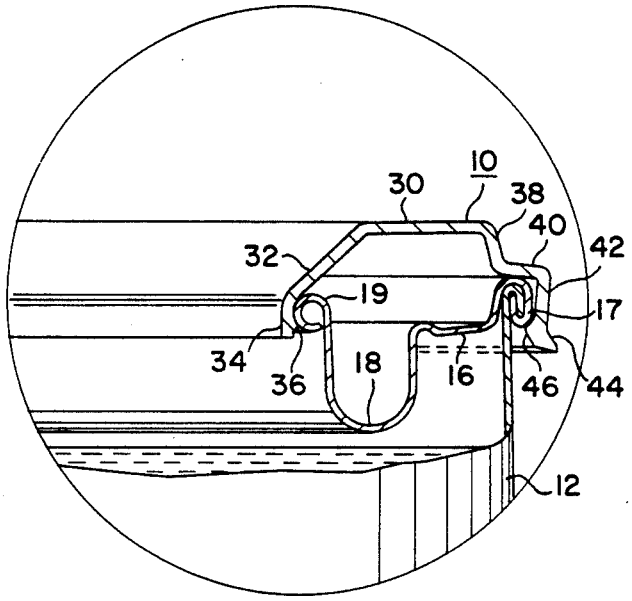
FIG. 6 is an enlarged fragmentary sectional elevational view of that portion of the can and rim seal enclosed by the dot and dash circle in FIG. 5 and designated FIG. 6.
Figure 7:
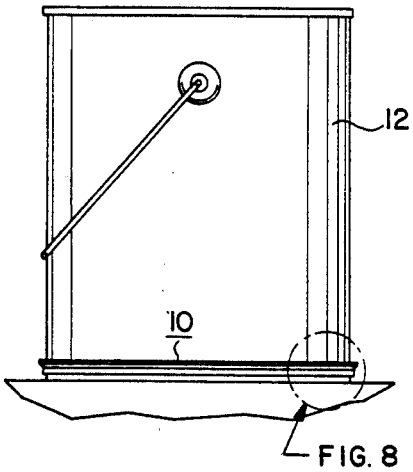
FIG. 7 is a side elevational view of a paint can with the rim seal of the present invention applied to the lower terminal edge for supporting the can during use for example.

This configuration has several advantages. It provides for the stacking of the rim seals in the manner shown in FIG. 10 for automatic assembly application in the manner described below. It also insures good tight seating of the rim seal on the container in the manner shown in the drawings, and allows for normal tolerance deviations for the same nominally sized cans. This configuration also facilitates distribution of the forces produced on assembly of the rim seal to the paint can. In other words, by a locally applied downwardly directed force indicated by the arrow F, the inner and outer wall sections $W_i$ and $W_o$ flex outwardly and return to a seated position simply by applying a downward force to the planar upper wall 30 in the manner shown. On assembly of the rim seal, the elastic memory of the material produces an inward continuous force resulting in tight seating of ribs 36 and 46 with the area of can which they contact. (see FIGS. 4 and 6) For example, in FIG. 4, the bead 46 snugly embraces the chime 17 to securely retain the rim seal in place. In FIG. 6 with the lid removed, the bead 36 envelops the under cut of the inner rolled lip 19 for good retention and provides a tight peripheral seal preventing undesirable egress of paint to the lid retention groove 18. The rim seal then functions to produce a "clothes pin" effect to insure a thorough seal peripherally in the regions indicated and shown in the drawings.

Figures 9, 10:
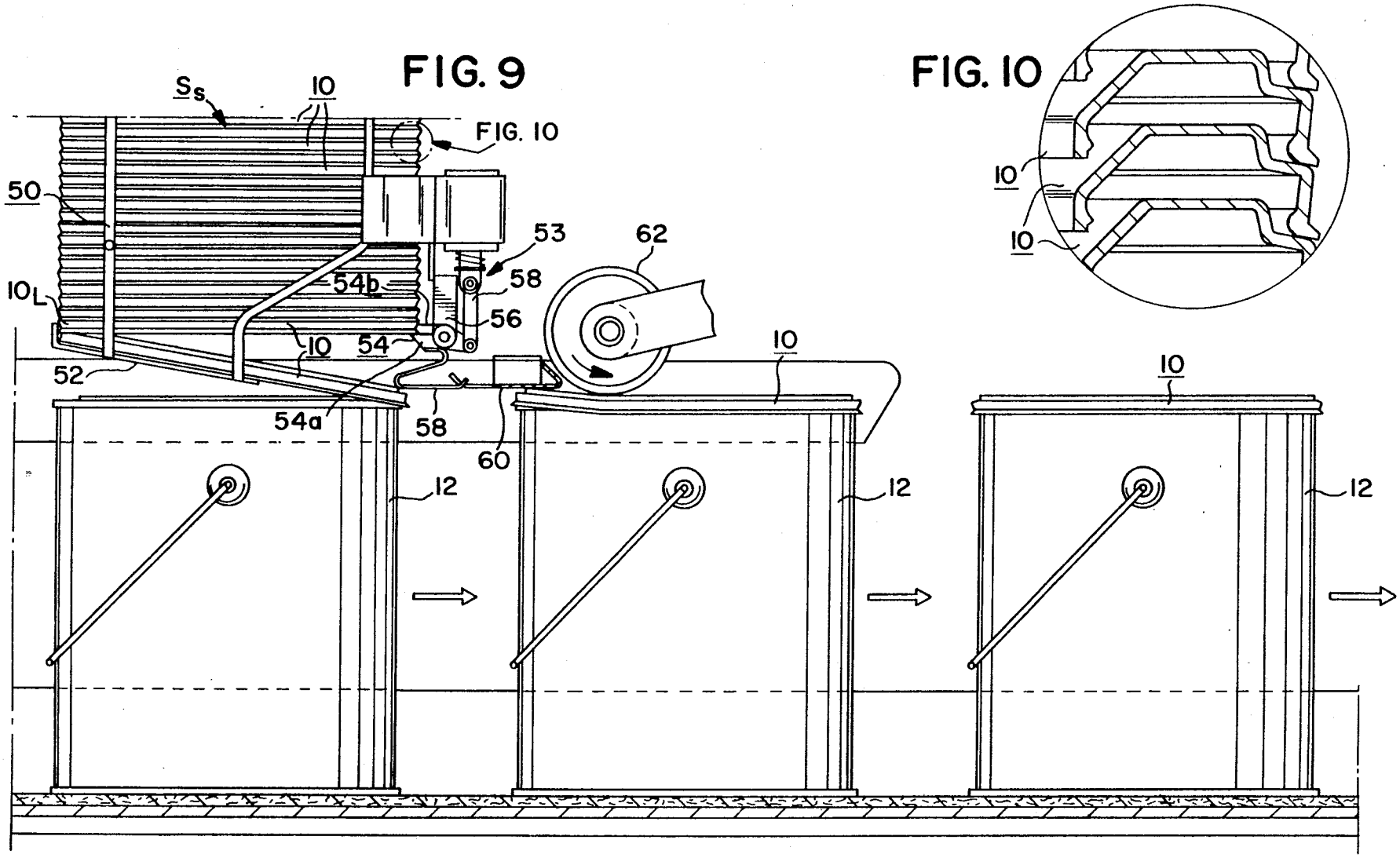
FIG. 9 is a schematic view showing an apparatus and system or method for automatically applying paint rim seal to paint cans for stacking and/or packing purposes.
FIG. 10 is an enlarged fragmentary sectional elevational view showing the nesting of the rim seals relative to one another by the enclosed dot and dash circle shown in FIG. 9 and designated FIG. 10.
Figure 11A:
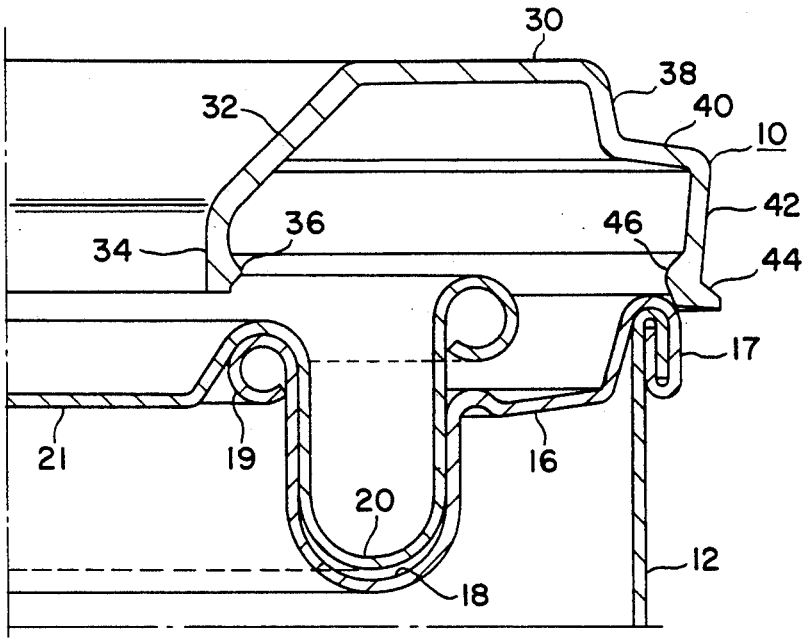
FIGS. 11A-11C inclusive are enlarged fragmentary sectional views showing sequential application of a paint can rim seal in accordance with the present invention.
Figure 11B:
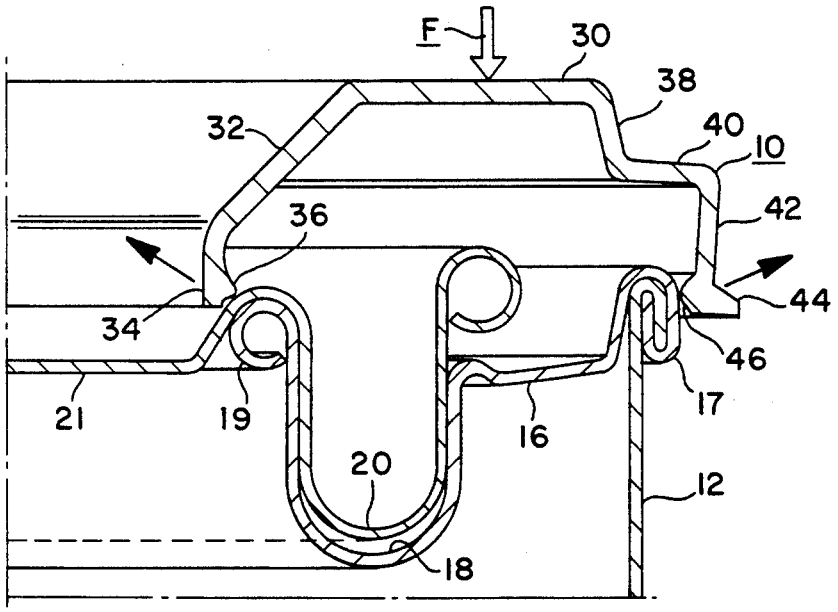
Figure 11C:
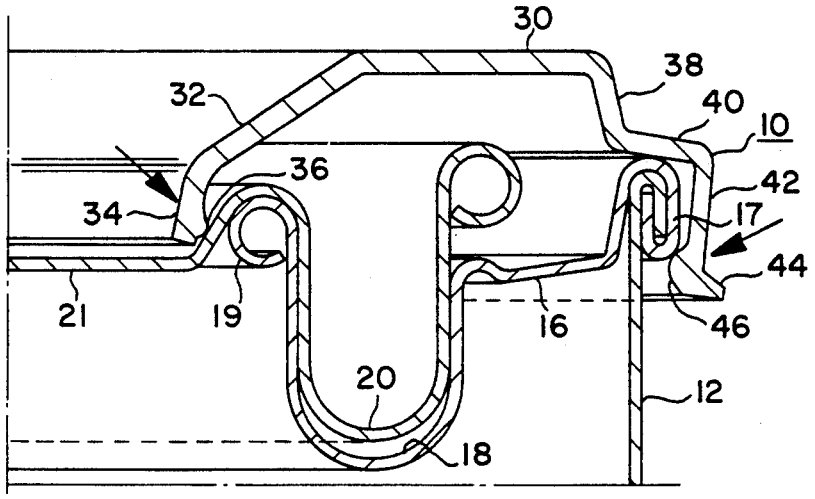

A system and method for automatically assembling the rim seals to paint cans constructed in accordance with the present invention is shown schematically in FIGS. 9 and 10. Rim seals stacked in the manner shown in FIG. 10 are supported one on top of the other at a stacking station $S_s$ to be applied one at a time to paint cans conveyed through the station in a line by conventional conveyor means. As illustrated, the rim seals are supported in an open frame broadly designated by numeral 50 having an inclined discharged ramp 52 at its lower end. A discharge or feed mechanism 53 releases one rim seal at a time on demand. To this end, the mechanism includes a bifurcated pawl 54 pivotally mounted at the lower end of a fixed link or bracket 56 and solenoid operated actuating link 58 for cycling the pawl 54 between an upper position, wherein the lower pawl finger 54*a* supports the lowermost rim seal $IO_L$ in the stack and the upper finger 58*b* supports the rim seal above the lower one, and a lower pivot position wherein the rim seal $10_L$ at the bottom of the stack is released to pivot downwardly and the retaining finger 54*b* of the pawl 54 holds the remainder of the stack. The bifurcated pawl 54 mounts a hold down spring 58 which pivots counterclockwise with the pawl 54 when solenoid is actuated allowing the lowermost rim seal to drop on to ramp 52 and returns to a position engaging the top wall 30 of the inner rim seal to insure engagement of the rim seal by the lead edge of a can as it passes through the station $S_s$ in the manner shown at position A in FIG. 9. A sensor, operatively associated with the solenoid, cycles the link when a rim seal is displaced from the stack by a can passing through the station. During movement of the can from position A to position B, the rim seal is engaged by the leading edge of paint can and passes under a hold down plate 60. A roller 62 engages the top wall 30 to press the top wall downwardly by the force F to assemble the rim seal to the can in the manner shown in FIGS. 11A, 11B and 11C. The paint cans may then be stacked in suitable close knit array in numbers of four (4) or six (6) in a shrink wrap for shipment. This type of packaging eliminates the need for, and the cost of, cardboard containers or the like.

There is shown in FIGS. 12 and 13, a modified form of a rim seal in accordance with the present invention. The general configuration of the rim seal, including the arrangement of top, inner, and outer wall sections $_i$ s generally similar to the preferred embodiment. FIGS. 12 and 13 have been given the same numerals with an "a" subscript. In accordance with this embodiment of the invention, the rim seal is provided with a series of circumferentially spaced inwardly directed ramps 48 of generally oval shaped configuration which define pouring spouts directing a stream of paint during a pouring operation in a controlled manner. The ramps 48 as illustrated extend from the juncture of the axial inner wall and top wall at its greatest point to the juncture of the top wall and the upper axial outer wall section $W_o$.

The rim seal can be applied manually by a user simply by placing it over the top of the can and then applying a force to the planar wall 30 which as described previously causes equal displacement of the inner and outer wall sections $W_i$ and $W_o$ to produce the tight seating of the rim seal on the can in a very simple operation. The configuration of the planar wall which is really a force distribution bridging wall produces substantially equal outward deflection of the inner and outer wall sections $W_i$ and $W_o$ and when the force is released, the elastic memory returns the sections inwardly to embrace the portions of the can in the manner described above.

Even though particular embodiments of the present invention have been illustrated and described herein, it is not intended to limit the invention and changes and modifications may be made therein within the scope of the following claims.

What is claimed is:

1. A rim seal device for use with containers for paint having an upstanding rim at one end and a groove located radially inwardly of the rim defined in part by an inner terminal edge comprising:

an annular top section disposed generally transversely to the axis of a container and providing a planar support surface when assembled to a container;

an inner wall section extending downwardly at an obtuse angle from the inner peripheral edge of said top section terminating in a radially inwardly directed rib adapted to overlie and seal with the edge of the container;

an angular outer section depending from the outer peripheral edge of said top section including a downwardly extending portion, a radially outward extending section attached thereto defining a ledge spaced below said planar support surface and a lower terminal axially extending wall terminating and having an inwardly directed radial circumferentially extending rib, said rim seal having a substantially uniform thickness;

whereby application of an axial force on said top section produces outward flexing of said inner and outer sections whereby said rim seal can be applied to a container by automatic assembly means.

2. A rim seal as claimed in claim 1 wherein said outer wall section includes a generally radially directed ledge extending downwardly at a slight angle relative to a transverse plane through the axis of the container.

3. A rim seal as claimed in claim 2 wherein the outer wall section includes a lower axial wall depending from the outer periphery of the ledge and canted inwardly at a slight angle.

4. A rim seal as claimed in claim 3 wherein said lower axial wall has an outwardly directed skirt which deflects paint radially outwardly relative to the cylindrical wall of a paint can.

5. A rim seal as claimed in claim 1 including a series of circumferentially spaced inwardly directed ramps of generally oval shaped configuration disposed at the juncture of top section and inner wall section define pouring spouts directing a stream of paint during a pouring operation.

* * * * *